US011001467B2

(12) United States Patent
Hanamoto

(10) Patent No.: US 11,001,467 B2
(45) Date of Patent: May 11, 2021

(54) PIVOTABLE TRAY FOR JAM CLEARANCE IN SHEET FOLDING DEVICE

(71) Applicant: KYOCERA Document Solutions Inc., Osaka (JP)

(72) Inventor: Katsuhiko Hanamoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 69 days.

(21) Appl. No.: 16/510,683

(22) Filed: Jul. 12, 2019

(65) Prior Publication Data

US 2020/0024094 A1 Jan. 23, 2020

(30) Foreign Application Priority Data

Jul. 19, 2018 (JP) ..... JP2018-135664

(51) Int. Cl.
*B65H 45/12* (2006.01)
*B65H 23/04* (2006.01)

(52) U.S. Cl.
CPC ..... *B65H 23/048* (2013.01); *B65H 45/12* (2013.01); *B65H 2405/10* (2013.01); *B65H 2801/27* (2013.01)

(58) Field of Classification Search
CPC .. B65H 37/06; B65H 2601/11; B65H 23/048; B65H 45/12; B65H 2405/10; B65H 31/28; B65H 45/142; B65H 45/18; B65H 31/02; B65H 2405/1117; B65H 2405/11172; B65H 2405/1124; B65H 2405/1134
See application file for complete search history.

(56) References Cited

U.S. PATENT DOCUMENTS

| | | | | |
|---|---|---|---|---|
| 8,616,542 | B2 * | 12/2013 | Min | B65H 31/28 270/45 |
| 8,632,065 | B2 * | 1/2014 | Nozawa | B65H 31/02 270/58.28 |
| 8,931,773 | B2 * | 1/2015 | Sugiyama | B65H 29/6609 270/32 |
| 9,896,296 | B2 * | 2/2018 | Chikamoto | B65H 31/24 |
| 2020/0262671 | A1 * | 8/2020 | Kishimoto | B65H 31/02 |

FOREIGN PATENT DOCUMENTS

| | | | |
|---|---|---|---|
| JP | 2004331332 A | * | 11/2004 |
| JP | 2013-71799 A | | 4/2013 |

* cited by examiner

*Primary Examiner* — Patrick H Mackey
(74) *Attorney, Agent, or Firm* — Stein IP, LLC

(57) ABSTRACT

A paper sheet folding device (sheet folding device) 160 includes a paper sheet folding unit 60 and a tray unit 110 that is provided on one side surface 161*a* of a device main body 161 and includes a lower discharge tray 121 on which a paper sheet S discharged through a lower discharge port 85 is loaded. The tray unit 110 is pivotable in an up-down direction about a pivotal shaft 111. A discharge drive mechanism 132 is disposed at a center portion of the tray unit 110 in a paper sheet width direction.

13 Claims, 11 Drawing Sheets

PIVOTABLE TRAY FOR JAM CLEARANCE IN SHEET FOLDING DEVICE

INCORPORATION BY REFERENCE

This application is based upon and claims the benefit of priority from the corresponding Japanese Patent Application No. 2018-135664 filed on Jul. 19, 2018, the contents of which are incorporated herein by reference.

BACKGROUND

The present disclosure relates to a sheet folding device that performs a folding process with respect to a sheet, such as a paper sheet, on which an image has been formed by an image forming apparatus such as a copy machine or a printer, a sheet post-processor provided with the same, and an image forming system.

Conventionally, there has been used a paper sheet post-processor capable of stacking a plurality of paper sheets (sheets) on each of which an image has been formed by an image forming apparatus such as a copy machine or a printer and executing post-processing with respect to the paper sheets. Post-processing includes a binding process in which a bundle of paper sheets stacked is bound with a staple(s), a folding process in which a bundle of paper sheets is folded in two or three, and so on.

A known such paper sheet post-processor is provided with a paper sheet tray, a stapling device, a folding device, a paper sheet discharge port, and a discharge tray. A prescribed number of paper sheets are loaded on the paper sheet tray. The stapling device performs the binding process with respect to a bundle of paper sheets loaded on the paper sheet tray. The folding device performs the folding process with respect to a bundle of paper sheets loaded on the paper sheet tray. A bundle of paper sheets that has been subjected to the folding process is discharged through the paper sheet discharge port. A bundle of paper sheets discharged through the paper sheet discharge port is loaded on the discharge tray. The paper sheet post-processor is connected to an image forming apparatus, and the discharge tray, therefore, is provided on a side surface of the paper sheet post-processor opposite to the image forming apparatus.

The conventional paper sheet post-processor, however, is not so structured that, for example, at the occurrence of a jam (a paper jam) in a vicinity of the paper sheet tray, a jam clearing process can be performed from a discharge tray side. Because of this, performing the jam clearing process requires that the paper sheet post-processor be separated from the image forming apparatus, and then a side surface of the paper sheet post-processor on an image forming apparatus side be opened. Hence, the conventional paper sheet post-processor has been disadvantageous in that the jam clearing process takes time.

SUMMARY

A sheet folding device according to the present disclosure is provided with a device main body, a sheet tray that is built in the device main body and on which a sheet is carried in and the sheet is loaded, a folding unit that performs a folding process with respect to the sheet loaded on the sheet tray, a sheet discharge port that is provided on one side surface of the device main body and through which the sheet applied the folding process is discharged, and a tray unit that is provided on the one side surface of the device main body and includes a discharge tray on which the sheet discharged through the sheet discharge port is loaded. The tray unit is supported to the device main body so as to be pivotable in an up-down direction about a pivotal shaft that is provided at an end portion of the tray unit on an upstream side in a sheet discharge direction and extends in a sheet width direction orthogonal to the sheet discharge direction. The tray unit includes a pair of conveyance members that is arranged respectively on both sides with respect to a center portion of the discharge tray in the sheet width direction and convey the sheet on the discharge tray to a downstream side in the sheet discharge direction, a drive mechanism that is disposed, below the discharge tray, between the pair of conveyance members and at the center portion of the discharge tray in the sheet width direction and drives the pair of conveyance members, and a drive housing that houses the drive mechanism.

Further features and advantages of the present disclosure will become more apparent from the description of an embodiment given below.

DETAILED DESCRIPTION

With reference to the appended drawings, the following describes an embodiment of the present disclosure.

With reference to FIG. 1 to FIG. 16, a description is given of an image forming system composed of a paper sheet post-processor (sheet post-processor) 30 according to one embodiment of the present disclosure and an image forming apparatus 10 to which the paper sheet post-processor 30 is connected. While this embodiment illustratively shows a multi-functional peripheral as one example of the image forming apparatus 10, the paper sheet post-processor 30 according to the present disclosure is also connectable to other types of image forming apparatuses than a digital multi-functional peripheral, such as a laser printer, an inkjet printer, and a facsimile apparatus.

Figure 1:
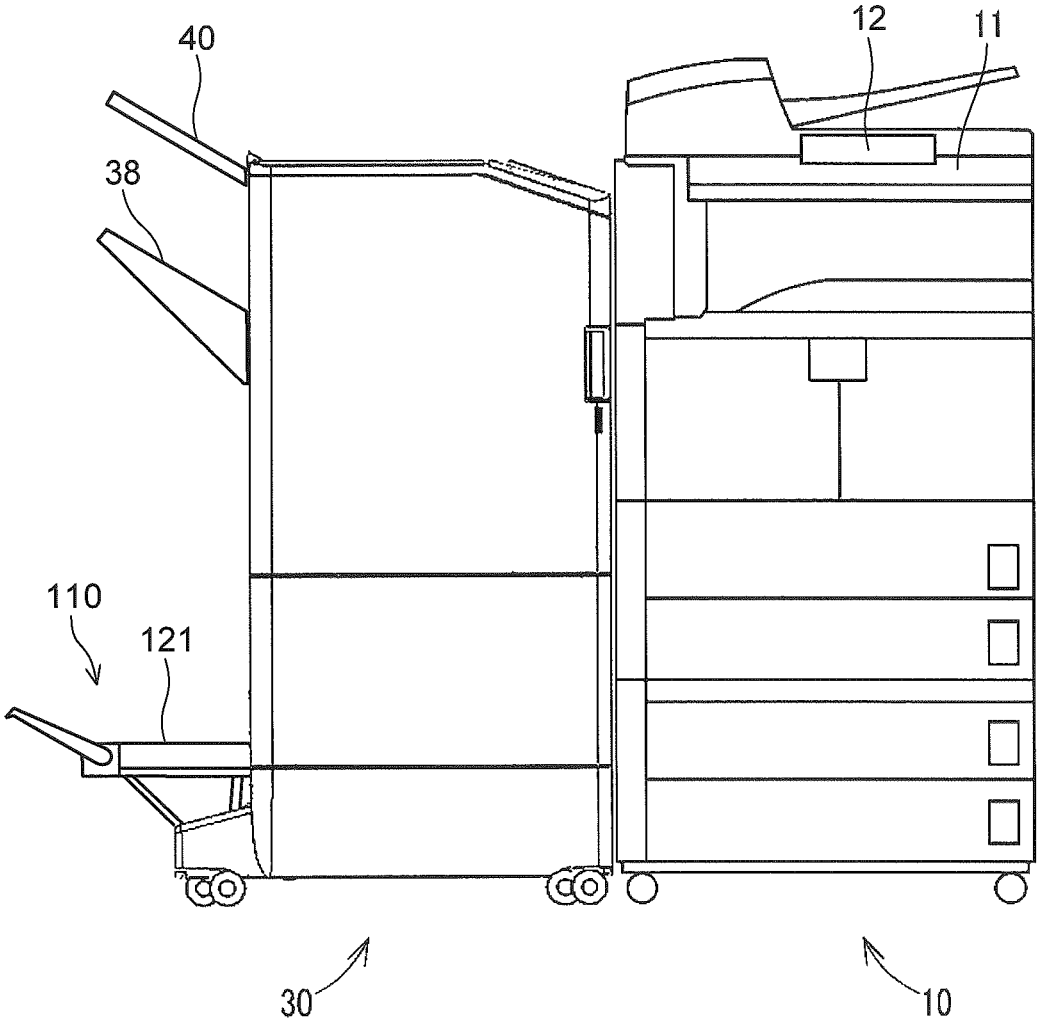
FIG. 1 is a schematic view showing a configuration of an image forming system composed of a paper sheet post-processor according to an embodiment of the present disclosure and an image forming apparatus to which the paper sheet post-processor is connected.

As shown in FIG. 1, the image forming apparatus 10 is used in a state of being connected to the paper sheet post-processor 30. Based on image data externally inputted via an unshown network communication portion, the image forming apparatus 10 prints an image on a paper sheet (sheet). Furthermore, based on image data read by an image reading portion 11 disposed in an upper part of the image forming apparatus 10, the image forming apparatus 10 prints an image on a paper sheet.

Figure 2:
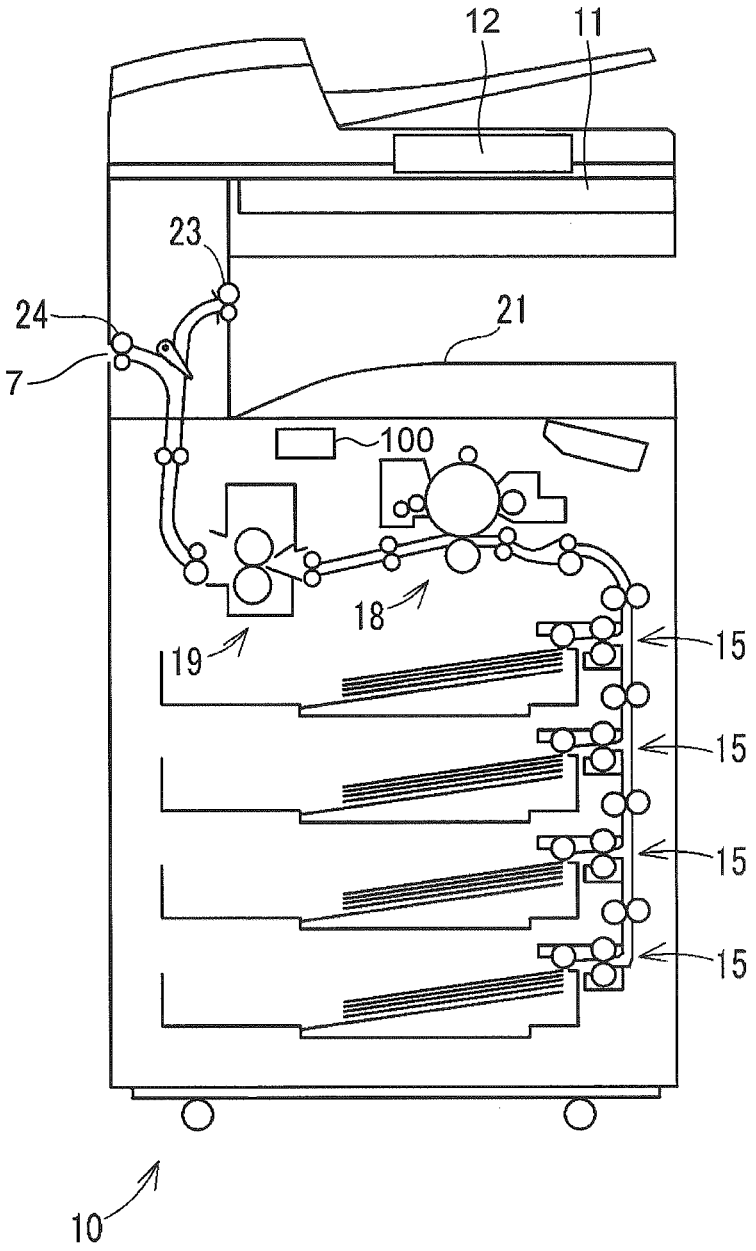
FIG. 2 is a sectional view showing a configuration of the image forming apparatus to which the paper sheet post-processor according to the embodiment of the present disclosure is connected.

As shown in FIG. 2, the image forming apparatus 10 includes a paper feed portion 15, an image forming portion 18, a fixing portion 19, ejection roller pairs 23 and 24, and a main body control portion 100. The paper feed portion 15 feeds a paper sheet. The image forming portion 18 forms a toner image on the paper sheet. The fixing portion 19 fixes the toner image on the paper sheet. The ejection roller pairs 23 and 24 each convey the paper sheet that has been subjected to fixing and discharge it to a paper discharge portion 21 and to the paper sheet post-processor 30, respectively.

The main body control portion 100 controls operations of the image forming apparatus 10. Furthermore, the main body control portion 100 is configured to be communicable with an after-mentioned post-processing control portion 101 of the paper sheet post-processor 30 and controls the post-processing control portion 101.

The paper sheet post-processor 30 performs post-processing such as a punch hole forming process, the binding process, or the folding process with respect to a paper sheet conveyed from the image forming apparatus 10. The paper sheet post-processor 30 is not limited to performing post-processing with respect to a paper sheet automatically conveyed from the image forming apparatus 10. The paper sheet post-processor 30 may be configured so that it itself conveys a paper sheet placed on an unshown tray by a user to a position at which post-processing can be performed and performs the post-processing with respect to said paper sheet at this position.

Figure 3:
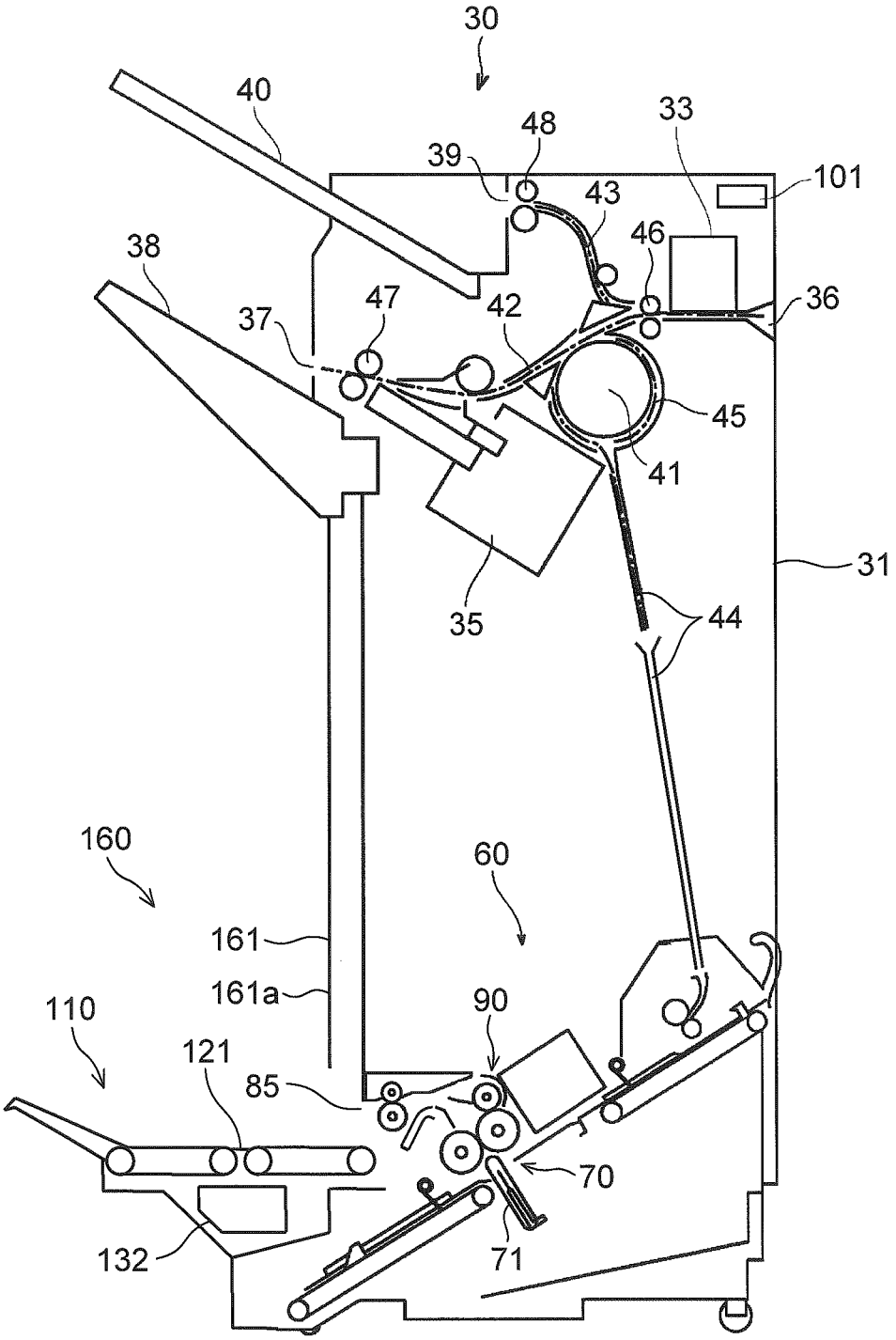
FIG. 3 is a sectional view showing a configuration of the paper sheet post-processor according to the embodiment of the present disclosure.

As shown in FIG. 3, the paper sheet post-processor 30 includes a punch hole forming device 33, a stapling unit 35, and a paper sheet folding unit (folding unit) 60. The punch hole forming device 33 performs a prescribed perforation process with respect to a paper sheet. The stapling unit 35 stacks a plurality of paper sheets and binds them with a staple(s). The paper sheet folding unit 60 performs the folding process with respect to a paper sheet. The punch hole forming device 33 and the stapling unit 35 are provided in a post-processing device main body 31.

The paper sheet post-processor 30 also includes a paper sheet carry-in port 36, a main discharge tray 38, a sub-discharge tray 40, a holding drum 41, the post-processing control portion 101, various types of switching members, and various types of rollers. A paper sheet discharged from a discharge portion 7 (see FIG. 2) of the image forming apparatus 10 is carried in through the paper sheet carry-in port 36. The main discharge tray 38 receives a paper sheet discharged through a main discharge port 37. The sub-discharge tray 40 receives a paper sheet discharged through a sub-discharge port 39. The holding drum 41 temporarily holds a paper sheet in a prescribed conveyance path. The post-processing control portion 101 controls the paper sheet post-processor 30 in a centralized manner.

The paper sheet carry-in port 36 communicates with the main discharge port 37 via a first conveyance path 42. A second conveyance path 43 branched off from the first conveyance path 42 is connected to the sub-discharge port 39. Furthermore, a third conveyance path 44 branched off from the first conveyance path 42 is connected to the paper sheet folding unit 60. A fourth conveyance path 45 branched off from the third conveyance path 44 is curved along a periphery of the holding drum 41 and merges into the first conveyance path 42.

A paper sheet carried in through the paper sheet carry-in port 36 is fed out to a downstream side by a registration roller pair 46. A main discharge roller pair 47 that feeds out a paper sheet onto the main discharge tray 38 is provided at a downstream end of the first conveyance path 42. When feeding out a paper sheet to the stapling unit 35, rollers of the main discharge roller pair 47 are separated from each other to release a nip therebetween. The main discharge tray 38 mainly receives a bundle of paper sheets that has been subjected to the binding process by the stapling unit 35. The main discharge tray 38 may be configured to receive a paper sheet that has not been subjected to post-processing or subjected only to the perforation process.

A sub-discharge roller pair 48 that feeds out a paper sheet onto the sub-discharge tray 40 is provided at a downstream end of the second conveyance path 43. The sub-discharge tray 40 mainly receives a paper sheet that is discharged without being subjected to post-processing in the paper sheet post-processor 30 or a paper sheet that has been subjected only to the perforation process.

Between the paper sheet carry-in port 36 and the registration roller pair 46, the punch hole forming device 33 is disposed above the first conveyance path 42 so as to be opposed to the first conveyance path 42. The punch hole forming device 33 performs, at prescribed timing, the perforation process with respect to a paper sheet conveyed along the first conveyance path 42.

The stapling unit 35 is disposed on a downstream side in the first conveyance path 42 and below the first conveyance path 42. The stapling unit 35 performs a stacking process in which a plurality of paper sheets are stacked into a bundle and the binding process in which a bundle of paper sheets stacked is bound with a staple(s).

In a case where a plurality of bundles of paper sheets are sequentially subjected to the binding process, while a preceding bundle of paper sheets is being subjected to the binding process, the holding drum 41 temporarily holds, on an outer peripheral surface thereof, a first paper sheet that is to form a succeeding bundle of paper sheets. After that, the holding drum 41 conveys, to the stapling unit 35, the first sheet in a state of being overlaid on a second paper sheet.

Next, a description is given of the paper sheet folding unit 60 of the paper sheet post-processor 30. In the following description, for the sake of convenience, a "paper sheet S" is assumed to encompass not only a single paper sheet S but also a bundle of a plurality of paper sheets S.

Figure 4:
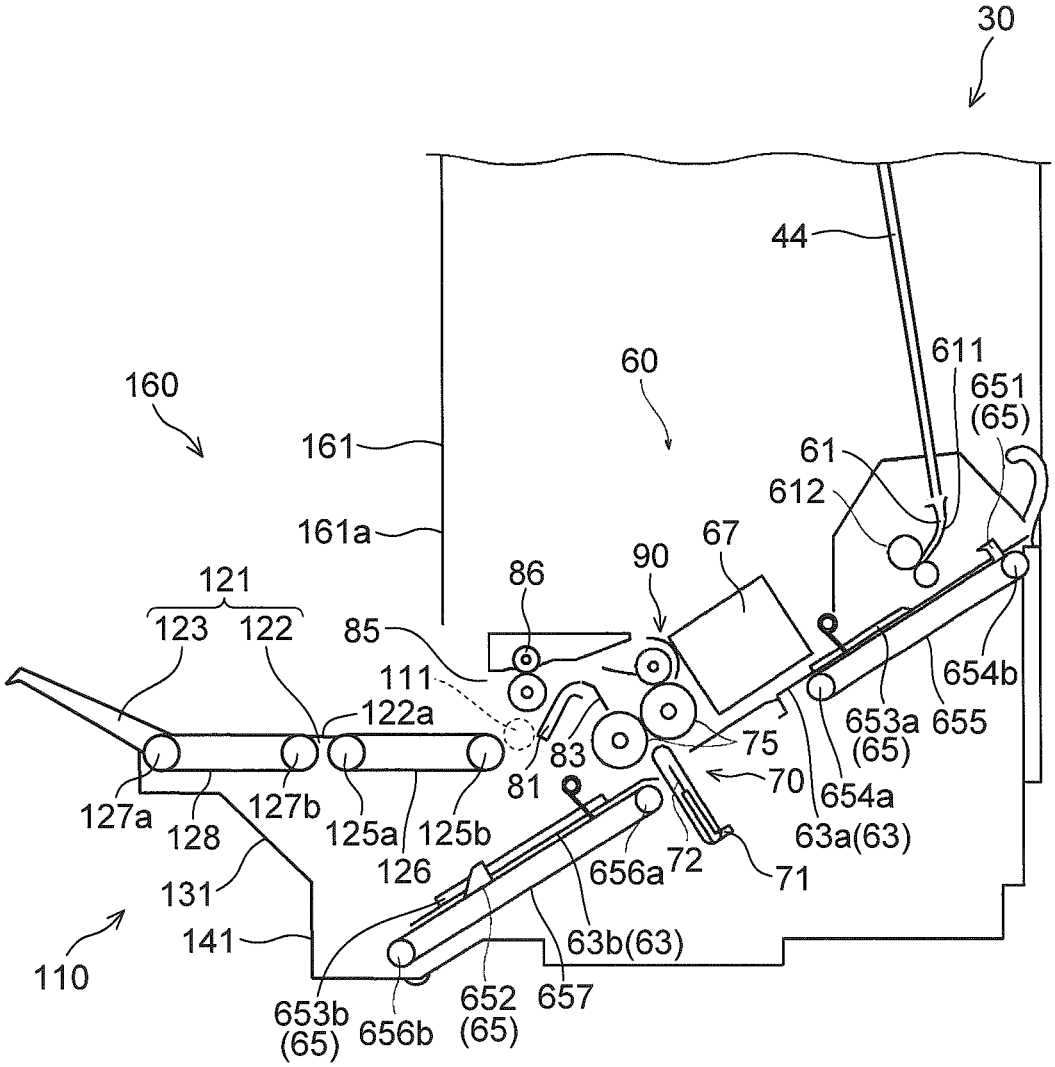
FIG. 4 is a sectional view showing a structure in a vicinity of a tray unit of the paper sheet post-processor according to the embodiment of the present disclosure.

As shown in FIG. 4, the paper sheet folding unit 60 is provided in a lower part of the paper sheet post-processor 30 and on a downstream side in the third conveyance path 44. For example, when the folding process is selected by a user, the paper sheet folding unit 60 performs the folding process in which the paper sheet S is folded in two or three.

The paper sheet folding unit 60 includes a paper sheet carry-in path 61, a paper sheet tray (sheet tray) 63, and an alignment member 65. The paper sheet carry-in path 61 connects to a downstream end of the third conveyance path 44. The paper sheet tray 63 is composed of an upstream side paper sheet loading portion 63*a* and a downstream side paper sheet loading portion 63*b* on which the paper sheet S carried in from the paper sheet carry-in path 61 is loaded. The alignment member 65 aligns a position of the paper sheet S loaded on the paper sheet tray 63.

The paper sheet folding unit 60 also includes a first folding device 70, a standby path 81, and a second folding device 90. The first folding device 70 performs a first folding process in which the paper sheet S is folded in two. The standby path 81 is configured so that it can be entered by the paper sheet S that has been subjected to the first folding process by the first folding device 70. The second folding device 90 performs a second folding process in which the paper sheet S that has been subjected to the first folding process by the first folding device 70 is folded in three.

The paper sheet folding unit 60 further includes a conveyance destination switching member 83 and a lower discharge tray (discharge tray) 121. The conveyance destination switching member 83 switches a conveyance destination of the paper sheet S that has been subjected to the first folding process by the first folding device 70. The lower discharge tray 121 receives the paper sheet S discharged through a lower discharge port (sheet discharge port) 85. A description is given later of a detailed structure of a tray unit 110 including the lower discharge tray 121.

The paper sheet carry-in path 61 is a carry-in path for carrying, into the paper sheet folding unit 60, the paper sheet S conveyed along the third conveyance path 44. The paper sheet carry-in path 61 is formed of a carry-in guide 611 that guides the paper sheet S. A carry-in roller pair 612 that feeds out the paper sheet S into the paper sheet folding unit 60 is provided at a downstream end of the carry-in guide 611.

The upstream side paper sheet loading portion 63*a* and the downstream side paper sheet loading portion 63*b* are each formed of, for example, a plate-shaped member and are provided in a straight line obliquely from an upper right side to a lower left side inside the paper sheet folding unit 60. Specifically, the upstream side paper sheet loading portion 63*a* is provided upstream from an after-mentioned push-out mechanism 71 in a paper sheet conveyance direction. On the other hand, the downstream side paper sheet loading portion 63*b* is provided downstream from the push-out mechanism 71 in the paper sheet conveyance direction so as to be spaced apart from the upstream side paper sheet loading portion 63*a*. Above the upstream side paper sheet loading portion 63*a*, there is provided a stapling device 67 that performs the binding process with respect to a bundle of paper sheets to be subjected to the folding process in the first folding device 70.

The alignment member 65 includes an upper movement member 651, a lower movement member 652, a width alignment member 653*a*, and a width alignment member 653*b*. The lower movement member 652 aligns a front end of the paper sheet S placed on the upstream side paper sheet loading portion 63*a* and the downstream side paper sheet loading portion 63*b* (performs alignment). The upper movement member 651 aligns a rear end of the paper sheet S placed on the upstream side paper sheet loading portion 63*a* and the downstream side paper sheet loading portion 63*b* (perform alignment). The width alignment members 653*a* and 653*b* align side ends of the paper sheet S in a paper sheet width direction (sheet width direction) orthogonal to the paper sheet conveyance direction (perform alignment).

The upper movement member 651 is mounted to an upstream side belt 655 laid across an upstream side drive pulley 654*a* and an upstream side driven pulley 654*b* that are provided below the upstream side paper sheet loading portion 63*a*. The lower movement member 652 is mounted to a downstream side belt 657 laid across a downstream side drive pulley 656*a* and a downstream side driven pulley 656*b* that are provided below the downstream side paper sheet loading portion 63*b*. The lower movement member 652 receives the front end of the paper sheet S. The upper movement member 651 and the lower movement member 652 move so as to correspond to a size of the paper sheet S (a length thereof in the paper sheet conveyance direction). Thus, a position of the paper sheet S placed on the upstream side paper sheet loading portion 63*a* and the downstream side paper sheet loading portion 63*b* is aligned in the paper sheet conveyance direction (namely, a length direction of the paper sheet S).

A pair of width alignment members 653*a* are provided on the upstream side paper sheet loading portion 63*a* so as to be spaced from each other in the paper sheet width direction (a direction perpendicular to a plane of FIG. 4). A pair of width alignment members 653*b* are provided on the downstream side paper sheet loading portion 63*b* so as to be spaced from each other in the paper sheet width direction. The pair of width alignment members 653*a* are configured to move via a rack-and-pinion mechanism (not shown) so as to correspond to the size of the paper sheet S (the length thereof in the paper sheet width direction). Furthermore, the pair of width alignment members 653*b* are configured to move via a rack-and-pinion mechanism (not shown) so as to correspond to the size of the paper sheet S (the length thereof in the paper sheet width direction). With this configuration, the width alignment members 653*a* and 653*b* perform width alignment and skew feeding correction of the paper sheet S.

The alignment of the paper sheet S by the alignment member 65 is performed every time the paper sheet S is loaded one by one on the paper sheet tray 63. Further, upon the number of the paper sheets S reaching a prescribed number, the prescribed number of paper sheets S are subjected to the alignment by the alignment member 65 and then are transported to a binding process position or a folding process position.

The first folding device 70 includes the push-out mechanism 71 that pushes out the paper sheet S and a first folding roller pair 75 that performs the folding process with respect to the paper sheet S pushed out by the push-out mechanism 71.

Between the upstream side paper sheet loading portion 63*a* and the downstream side paper sheet loading portion 63*b*, the push-out mechanism 71 is provided below the first folding roller pair 75. The push-out mechanism 71 includes a folding blade 72 that is made of sheet metal and comes into contact with a lower side of the paper sheet S. The push-out mechanism 71 also includes a motor and a power transmission mechanism (none of these is shown) that operate the folding blade 72 to move perpendicularly to the lower side of the paper sheet S. The folding blade 72 pushes out the paper sheet S so as to feed it into an after-mentioned first nip portion N1 (see FIG. 5) of the first folding roller pair 75.

Figure 5:
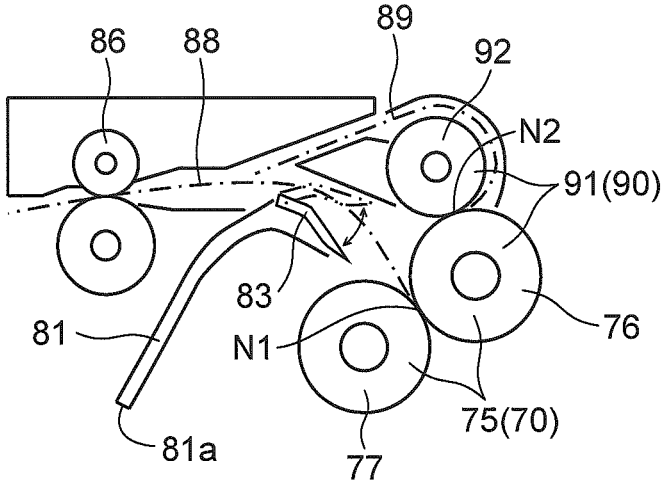
FIG. 5 is a view showing a structure in a vicinity of a first folding roller pair and a second folding roller pair of the paper sheet post-processor according to the embodiment of the present disclosure.

As shown in FIG. 5, the first folding roller pair 75 is composed of a first roller 76 and a second roller 77 positioned downstream from the first roller 76 in the paper sheet conveyance direction. The first roller 76 and the second roller 77 are driven to rotate by a motor via a power transmission mechanism (none of these is shown).

Between the first roller 76 and the second roller 77, the first nip portion N1 is formed, into which the paper sheet S is fed by the folding blade 72 (see FIG. 4) of the push-out mechanism 71. The paper sheet S is nipped by the first nip portion N1 and passes therethrough in that state, and thus a first fold is formed in the paper sheet S.

A first discharge conveyance path 88 connecting to the lower discharge port 85 (see FIG. 4) is provided on a downstream side with respect to the first nip portion N1 of the first folding roller pair 75. A discharge roller pair 86 is provided at a downstream end of the first discharge conveyance path 88. The first discharge conveyance path 88 is a conveyance path for conveying the paper sheet S that has been subjected to the first folding process to the lower discharge port 85 without subjecting it to the second folding process.

The standby path 81 is branched off from the first discharge conveyance path 88. The conveyance destination switching member 83 is provided at a branching portion between the standby path 81 and the first discharge conveyance path 88. The conveyance destination switching member 83 pivots so that a conveyance destination of the paper sheet S that has been subjected to the first folding process is switched between the first discharge conveyance path 88 and the standby path 81.

The standby path 81 is provided so as to be entered by the paper sheet S that has been subjected to the first folding process by the first folding device 70 and hold the paper sheet S while keeping it bent. The standby path 81 is provided on an opposite side to the first roller 76 with respect to the conveyance destination switching member 83. The standby path 81 is curved in a direction along a peripheral surface of the second roller 77.

The standby path 81 is formed so as to correspond to a thickness of a largest possible number of paper sheets S that can be subjected to the folding process by the paper sheet folding unit 60. For example, in a case where one to five paper sheets S can be folded in the folding process, the standby path 81 is configured to have an inside space that can be entered by the paper sheets S having a thickness of five paper sheets S folded (subjected to the first folding process) namely a thickness of ten paper sheets.

A stopper 81*a* is provided at a downstream end of the standby path 81. The first fold in the paper sheet S that has entered (has been held in) the standby path 81 strikes the stopper 81*a*.

The second folding device 90 performs the second folding process with respect to the paper sheet S in a state of having been subjected to the first folding process and then having struck the stopper 81*a*.

Specifically, the second folding device 90 includes a second folding roller pair 91 that performs the second folding process with respect to the paper sheet S that has been subjected to the first folding process. The second folding roller pair 91 is composed of the above-described first roller 76 and a third roller 92 that is positioned above the first roller 76. The first roller 76 is a common roller shared between the first folding roller pair 75 and the second folding roller pair 91. The third roller 92 is driven to rotate by a motor via a power transmission mechanism (none of these is shown).

Figure 6:
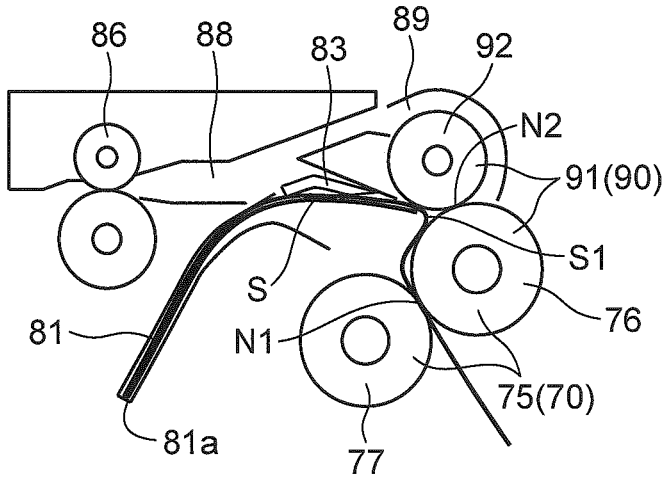
FIG. 6 is a view showing the structure in the vicinity of the first folding roller pair and the second folding roller pair of the paper sheet post-processor according to the embodiment of the present disclosure, which illustrates a state in which a bent portion is formed in a paper sheet that has been subjected to a first folding process.
Figure 7:
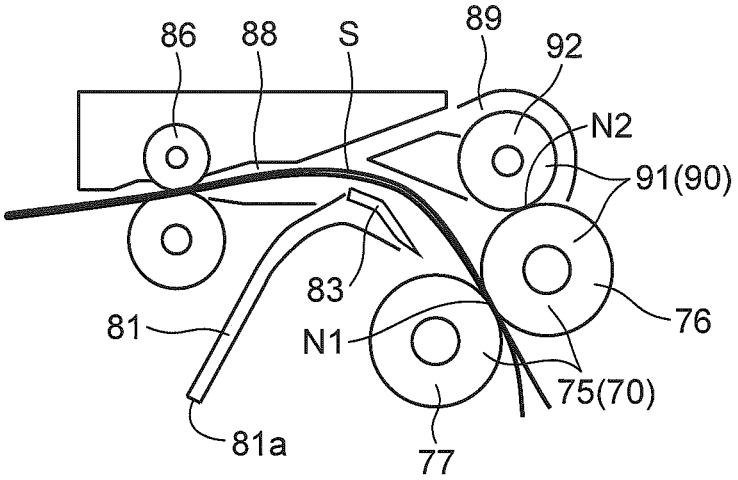
FIG. 7 is a view showing the structure in the vicinity of the first folding roller pair and the second folding roller pair of the paper sheet post-processor according to the embodiment of the present disclosure, which illustrates a state in which the sheet that has been subjected to the first folding process is discharged through a lower discharge port.

A second nip portion N2 is formed between the first roller 76 and the third roller 92. As shown in FIG. 6, the paper sheet S that has been subjected to the first folding process continues to be conveyed by the first folding roller pair 75 in a state where the front end of the paper sheet S is in contact with the stopper 81*a*, and thus a bent portion S1 is formed in the paper sheet S. The bent portion S1 passes through the second nip N2 of the second folding roller pair 91 while being nipped by the second nip portion N2, and thus a second fold is formed in the paper sheet S.

As shown in FIG. 5, on a downstream side with respect to the second nip portion N2 of the second folding roller pair 91, there is provided a second discharge conveyance path 89 that merges into the first discharge conveyance path 88. The second discharge conveyance path 89 is a conveyance path for conveying the paper sheet S that has been subjected to the second folding process to the lower discharge port 85 via the first discharge conveyance path 88.

Next, with reference to FIG. 4 to FIG. 7, a description is given of a folding process (operation) with respect to the paper sheet S performed by the paper sheet folding unit 60. The folding process with respect to the paper sheet S is executed by the post-processing control portion 101 (see FIG. 3) included in the paper sheet post-processor 30.

First, a description is given of a two-folding process. The two-folding process is performed in a case where a two-folding mode is selected by a user by use of an operation panel 12 (see FIG. 2) of the image forming apparatus 10. The conveyance destination switching member 83 pivots to a position indicated by a solid line in FIG. 5 so that a conveyance destination of the paper sheet S that has been subjected to the first folding process by the first folding device 70 is directed to the first discharge conveyance path 88.

The paper sheet S carried in through the paper sheet carry-in path 61 is placed on the upstream side paper sheet loading portion 63*a* and the downstream side paper sheet loading portion 63*b* and is aligned by the alignment member 65. Then, the alignment member 65 positions the paper sheet S at a prescribed position so that a folding position of the paper sheet S (a center portion thereof in the paper sheet conveyance direction) is opposed to a tip end of the folding blade 72.

Next, the folding blade 72 of the push-out mechanism 71 is projected to push the paper sheet S upward (in a direction perpendicular to the paper sheet S). At this time, the folding blade 72 comes into contact with the folding position of the paper sheet S. The paper sheet S that has thus been pushed out by the folding blade 72, while being bent, enters the first nip portion N1 of the first folding roller pair 75. The first fold is formed in the paper sheet S that has passed through the first nip portion N1.

The paper sheet S with the first fold formed therein passes through the first discharge conveyance path 88 (see FIG. 7) and is discharged through the after-mentioned lower discharge port 85 onto the lower discharge tray 121. As will be described later, the lower discharge port 85 is provided on one side surface 161*a* of a device main body 161. The push-out mechanism 71 returns the folding blade 72 to its original standby position. From then on, the folding process is sequentially performed in a similar manner.

Next, a description is given of a three-folding process. The three-folding process is performed in a case where a three-folding mode is selected by a user by use of the operation panel 12 (see FIG. 2) of the image forming apparatus 10. Process steps up to performing the first folding process with respect to the paper sheet S by the first folding device 70 are similar to those in the two-folding process except that a folding position of the paper sheet S is set to a position at a distance of about one-third of a length of the paper sheet S from the front end thereof, and therefore, descriptions thereof, are omitted.

The conveyance destination switching member 83 pivots to a position indicated by a chain double-dashed line in FIG. 5 so that a conveyance destination of the paper sheet S that has been subjected to the first folding process by the first folding device 70 is directed to the standby path 81. The paper sheet S that has been subjected to the first folding process, therefore, is conveyed toward the standby path 81 as shown in FIG. 6. The paper sheet S enters the standby path 81, and the first fold (the front end) of the paper sheet S strikes the stopper 81*a* of the standby path 81.

Even after the first fold of the paper sheet S has struck the stopper 81*a*, the first folding roller pair 75 continues to be driven to rotate. Consequently, as shown in FIG. 6, while being in contact with a curved inner surface of the standby path 81, the conveyance destination switching member 83, and so on, the paper sheet S is gradually bent into a convex shape toward the second nip portion N2 of the second folding roller pair 91.

A bent portion S1 formed in the paper sheet S (a position thereon at a distance of about one-third of the length of the paper sheet S from the rear end thereof) enters the second nip portion N2 of the second folding roller pair 91. The second fold is formed in the paper sheet S that has passed through the second nip portion N2. The paper sheet S with the second fold formed therein is conveyed along the second discharge conveyance path 89 while being wound on a peripheral surface of the third roller 92 and is discharged by the discharge roller pair 86 onto the lower discharge tray 121 through the lower discharge port 85.

Next, a description is given of a detailed structure of the tray unit 110 and a vicinity thereof. A paper sheet folding device 160 disposed inside the paper sheet post-processor 30 is composed of the tray unit 110, the paper sheet tray 63, the paper sheet folding unit 60, the lower discharge port 85, the device main body 161 (see FIG. 4) supporting these components, and so on. The paper sheet folding device 160 is one example of the "sheet folding device" of the present disclosure.

Figure 8:
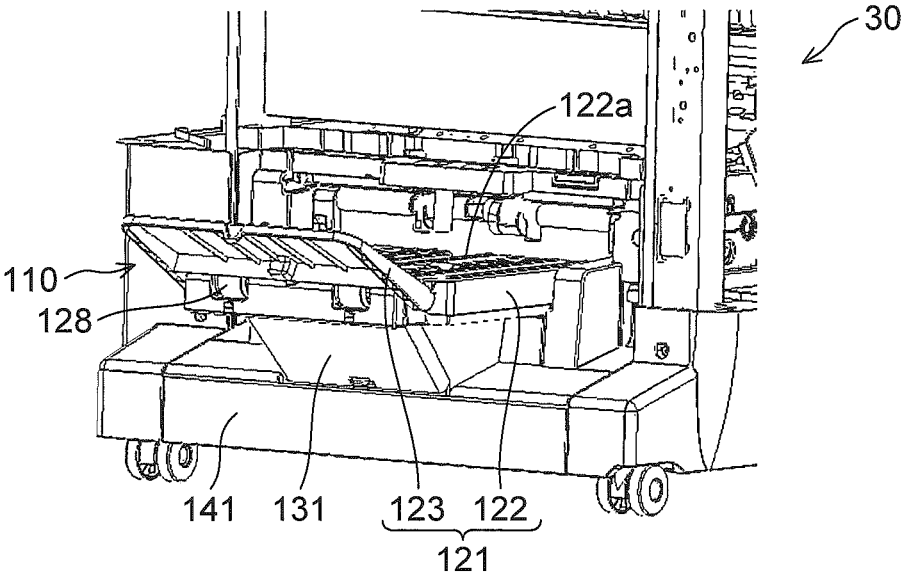
FIG. 8 is a perspective view showing the structure in the vicinity of the tray unit of the paper sheet post-processor according to the embodiment of the present disclosure, which illustrates a state in which the tray unit is disposed at a first position.

As shown in FIG. 4, the tray unit 110 is provided at a lower part of the one side surface 161*a* of the device main body 161 (a side surface thereof on an opposite side to the image forming apparatus 10). As shown in FIG. 4 and FIG. 8, the tray unit 110 is composed of the lower discharge tray 121, a drive housing 131, and a cover member 141.

The paper sheet S discharged through the lower discharge port 85 is loaded on the lower discharge tray 121. The drive housing 131 is disposed below the lower discharge tray 121. The cover member 141 is disposed below the drive housing 131. The drive housing 131 and the cover member 141 constitute part of an exterior surface of the post-processing device main body 31.

The lower discharge tray 121 includes a first tray portion 122 and a second tray portion 123. The first tray portion 122 has a placement surface 122*a* on which the paper sheet S discharged through the lower discharge port 85 is placed. The second tray portion 123 is provided at a downstream end of the first tray portion 122 in a paper sheet discharge direction so as to be continuous therewith. A lower end portion of the paper sheet tray 63 (see FIG. 4) is disposed at a position directly under an after-mentioned first discharge belt 126 of the first tray portion 122. Furthermore, the lower end portion of the paper sheet tray 63 is disposed downstream (a left side in FIG. 4) from an after-mentioned pivotal shaft 111 in the discharge direction.

Figure 9:
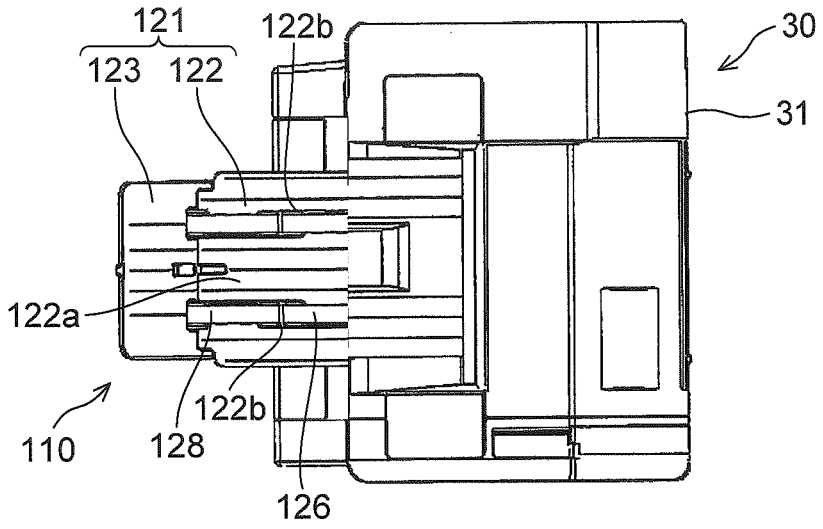
FIG. 9 is a view showing, from above, a structure of the paper sheet post-processor according to the embodiment of the present disclosure, which illustrates the state in which the tray unit is disposed at the first position.
Figure 10:
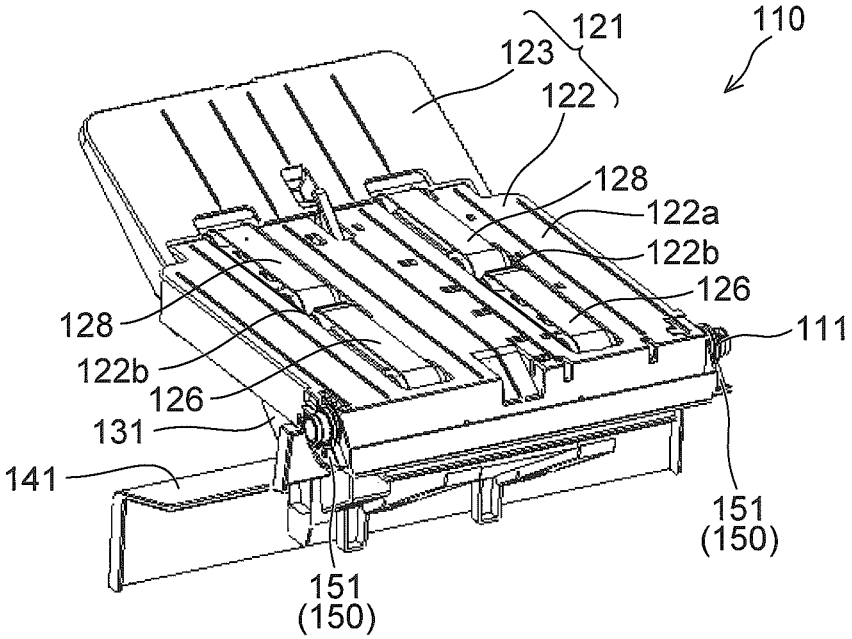
FIG. 10 is a perspective view showing a structure of the tray unit of the paper sheet post-processor according to the embodiment of the present disclosure.

As shown in FIG. 9 and FIG. 10, the placement surface 122*a* of the first tray portion 122 has a pair of opening portions 122*b* extending along the paper sheet discharge direction, which are provided at a prescribed distance from each other in the paper sheet width direction. In FIG. 9, for the sake of easier understanding, part of the sub-discharge tray 40 and the main discharge tray 38 are not shown.

Figure 11:
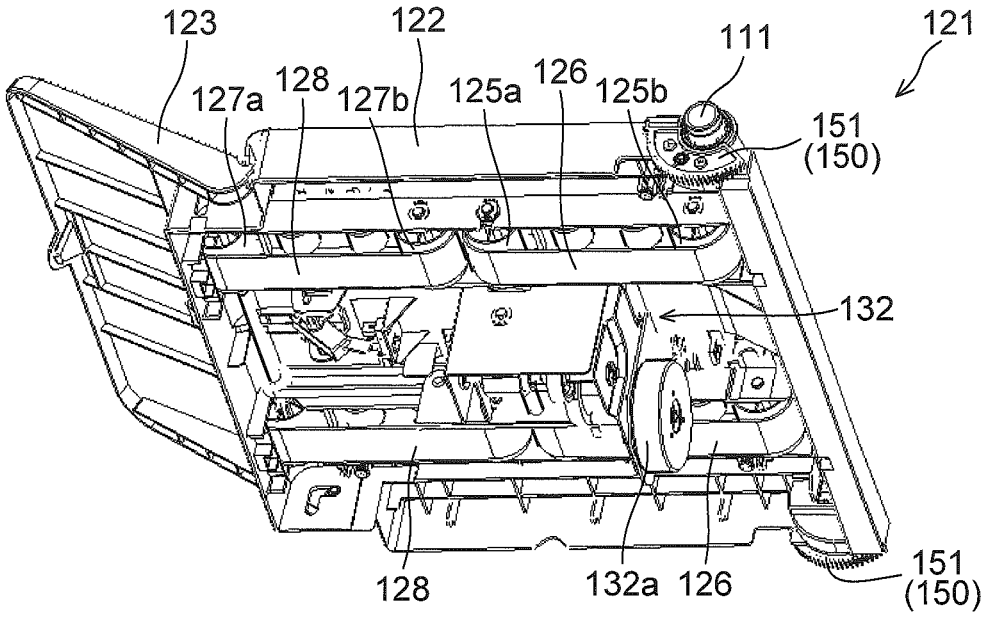
FIG. 11 is a perspective view showing, from below, a structure of a lower discharge tray of the tray unit of the paper sheet post-processor according to the embodiment of the present disclosure.

As shown in FIG. 4 and FIG. 11, a first drive pulley 125*a*, a first driven pulley 125*b*, a first discharge belt (conveyance member) 126, a second drive pulley 127*a*, a second driven pulley 127*b*, and a second discharge belt (conveyance member) 128 are arranged below the placement surface 122*a*.

The first discharge belt 126 is laid across the first drive pulley 125*a* and the first driven pulley 125*b*. The second discharge belt 128 is laid across the second drive pulley 127*a* and the second driven pulley 127*b*.

The first drive pulley 125*a*, the first driven pulley 125*b*, the first discharge belt 126, the second drive pulley 127*a*, the second driven pulley 127*b*, and the second discharge belt 128 are provided as a set, and a pair of these sets are provided so as to interpose therebetween a center portion of the lower discharge tray 121 in the paper sheet width direction.

The first discharge belt 126 and the second discharge belt 128 protrude upward beyond the placement surface 122*a* via each of the pair of opening portions 122*b* (see FIG. 10). The first drive pulley 125*a* rotates to cause the first discharge belt 126 and the first driven pulley 125*b* to rotate. Thus, the paper sheet S discharged through the lower discharge port 85 is conveyed from an upstream side to a downstream side. Furthermore, the second drive pulley 127*a* rotates to cause the second discharge belt 128 and the second driven pulley 127*b* to rotate. Thus, the paper sheet S is further conveyed from the upstream side to the downstream side.

Typically, the second tray portion 123 is mounted so as to be inclined upward toward the downstream side. The second tray portion 123 prevents the paper sheet S on the first tray portion 122 from dropping by being pushed out by a succeeding paper sheet S.

A discharge drive mechanism (drive mechanism) 132 (see FIG. 3 and FIG. 11) is housed inside the drive housing 131. The discharge drive mechanism 132 includes a discharge motor 132*a* (see FIG. 11) and a gear train that transmits a rotational drive force of the discharge motor 132*a* to the first drive pulley 125*a* and the second drive pulley 127*a*.

Figure 12:
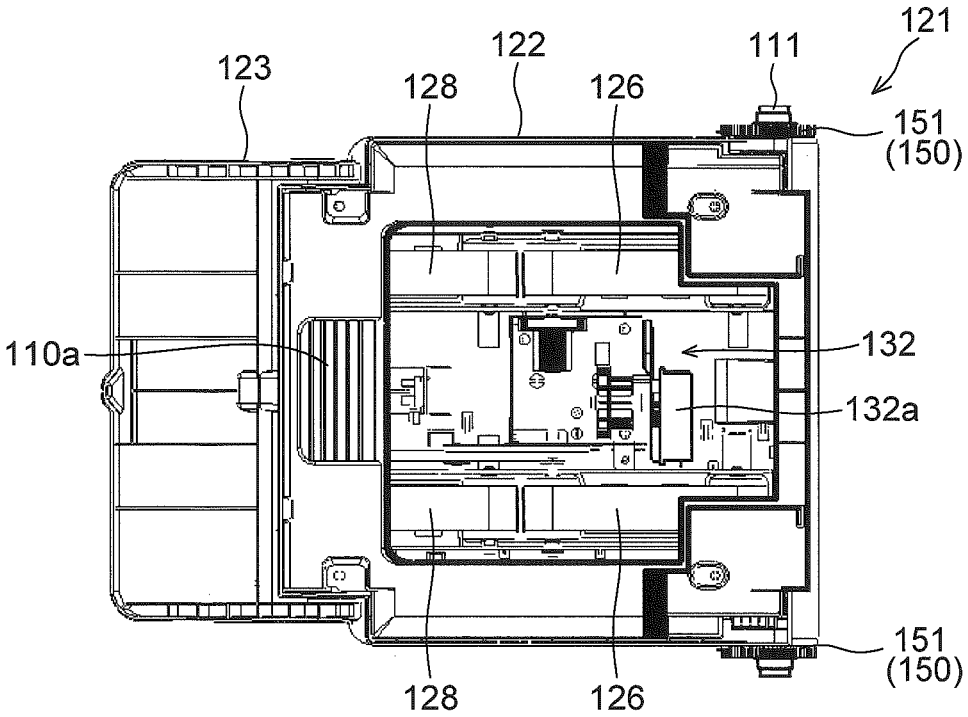
FIG. 12 is a view showing, from below, the structure of the lower discharge tray of the tray unit of the paper sheet post-processor according to the embodiment of the present disclosure.
Figure 13:
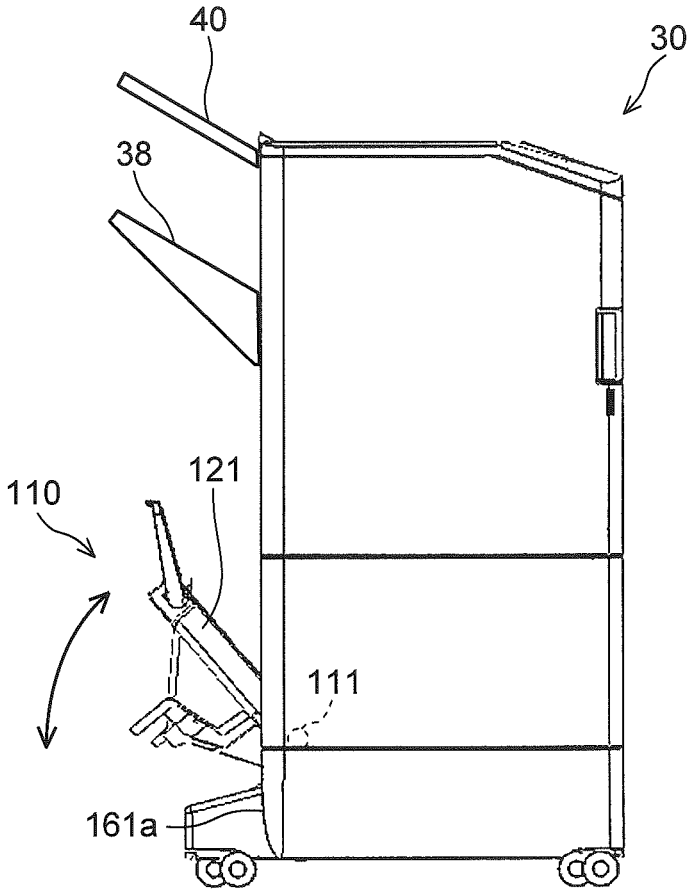
FIG. 13 is a side view showing the structure of the paper sheet post-processor according to the embodiment of the present disclosure, which illustrates a state in which the tray unit is disposed at a second position.

As shown in FIG. 11 and FIG. 12, the discharge drive mechanism 132 is disposed between the first and second discharge belts 126 and 128 provided on one side with respect to the center portion and the first and second discharge belts 126 and 128 provided on the other side. Furthermore, the discharge drive mechanism 132 is disposed at a center portion of the tray unit 110 in the paper sheet width direction.

Here, the tray unit 110 is configured to be disposed selectively at a first position or at a second position. The first position (a position shown in FIG. 4 and FIG. 8) is such a position that the paper sheet S discharged through the lower discharge port 85 can be loaded on the lower discharge tray 121. The second position (a position shown in FIG. 13 and FIG. 14) is such a position that the paper sheet tray 63 inside the device main body 161 is exposed from the one side surface 161*a*. The tray unit 110 at the second position is disposed above the tray unit 110 at the first position.

Specifically, as shown in FIG. 10 and FIG. 11, at both end portions of the tray unit 110 on an upstream side in the paper sheet discharge direction, there is provided the pivotal shaft 111 that extends in the paper sheet width direction. The pivotal shaft 111 is supported to the device main body 161. The tray unit 110 pivots about the pivotal shaft 111 in an up-down direction and thus is disposed selectively at the first position (the position shown in FIG. 8) or at the second position (the position shown in FIG. 14).

Figure 14:
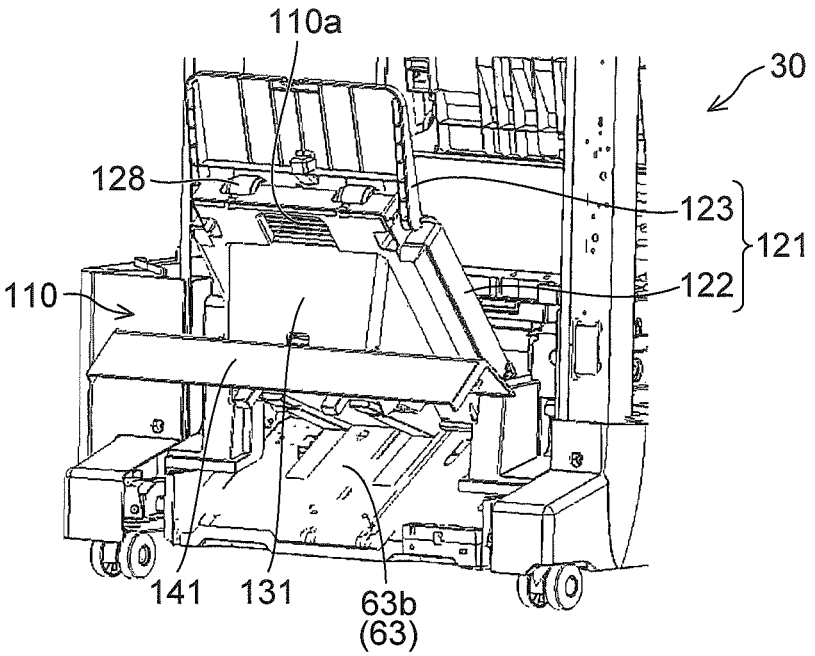
FIG. 14 is a perspective view showing the structure in the vicinity of the tray unit of the paper sheet post-processor according to the embodiment of the present disclosure, which illustrates the state in which the tray unit is disposed at the second position.

When the tray unit 110 is disposed at the second position as shown in FIG. 14, a vicinity of a lower end portion of the paper sheet tray 63 is exposed. Thus, the paper sheet S jammed in the paper sheet tray 63, the first folding device 70, or the like (see FIG. 4) can be removed via an area below the tray unit 110.

Furthermore, a handle 110*a* (see FIG. 14) is provided on the back of the lower discharge tray 121 of the tray unit 110. The handle 110*a* is provided at an end portion of the lower discharge tray 121 on a downstream side in the paper sheet discharge direction and at the center portion thereof in the paper sheet width direction (here, on a lower surface of the first tray portion 122 at an end portion thereof on a downstream side and at a center portion thereof in the paper sheet width direction). An operator who operates the tray unit 110 to pivot between the first position and the second position hooks his/her finger on the handle 110*a*.

Figure 15:
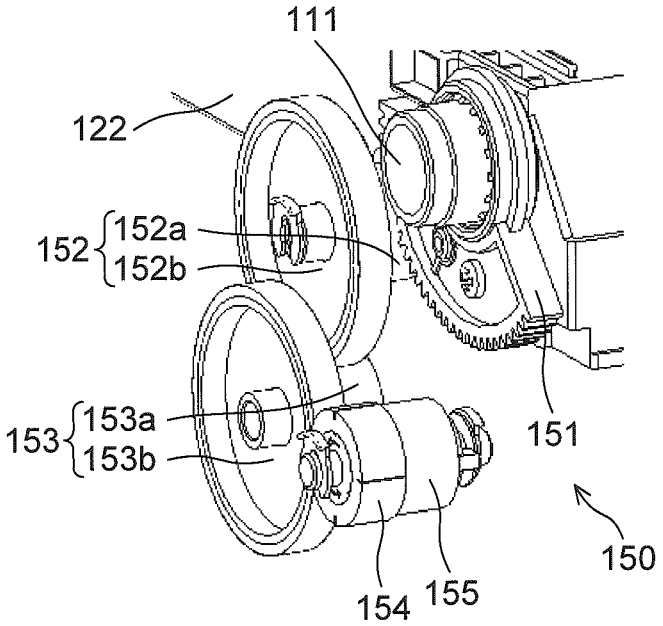
FIG. 15 is a perspective view showing a structure of a discharge drive mechanism of the paper sheet post-processor according to the embodiment of the present disclosure.

Here, in this embodiment, as shown in FIG. 15, the paper sheet post-processor 30 includes a load mechanism 150 that applies a pivotal load to the tray unit 110. While the load mechanism 150 is provided on each of both sides of the tray unit 110 in the paper sheet width direction, since a pair of load mechanisms 150 are configured to be substantially symmetrical to each other, FIG. 15 only shows one of the pair of load mechanisms 150.

Each of the pair of load mechanisms 150 is composed of a pivotal gear 151, a two-stage gear 152, a two-stage gear 153, a one-way gear 154, and a torque limiter 155. The pivotal gear 151 is formed in a fan shape. The two-stage gear 152 is connected to the pivotal gear 151. The two-stage gear 153 is connected to the two-stage gear 152. The one-way gear 154 is connected to the two-stage gear 153. The one-way gear 154 is mounted to a shaft portion of the torque limiter 155. The pivotal gear 151 and the two-stage gears 152 and 153 are one example of the "load transmission member" of the present disclosure, and the one-way gear 154 is one example of each of the "load transmission member" and the "one-way mechanism" of the present disclosure.

The pivotal gear 151 is provided at the pivotal shaft 111 of the tray unit 110 and pivots integrally with the tray unit 110. For example, the pivotal gear 151 may be fixed to the lower discharge tray 121 of the tray unit 110. Alternatively, the pivotal gear 151 may be fixed to the pivotal shaft 111, and the lower discharge tray 121 may also be fixed to the pivotal shaft 111. In either of these configurations, the pivotal gear 151 pivots integrally with the tray unit 110, and a pivotal load can be applied to the tray unit 110 via the pivotal gear 151.

The two-stage gear 152 includes a small diameter portion 152*a* that engages with the pivotal gear 151 and a large diameter portion 152*b* that rotates integrally with the small diameter portion 152*a*. The two-stage gear 152 accelerates a pivoting motion of the pivotal gear 151 and transmits the accelerated pivoting motion to the two-stage gear 153. The small diameter portion 152*a* and the large diameter portion 152*b* are formed integrally with each other by resin molding.

The two-stage gear 153 includes a small diameter portion 153*a* that engages with the large diameter portion 152*b* of the two-stage gear 152 and a large diameter portion 153*b* that rotates integrally with the small diameter portion 153*a* and engages with the one-way gear 154. The two-stage gear 153 accelerates rotation of the two-stage gear 152 and transmits the accelerated rotation to the one-way gear 154. The small diameter portion 153*a* and the large diameter portion 153*b* are formed integrally with each other by resin molding.

The one-way gear 154 is configured to be able to transmit a rotational force only in one direction. Here, the one-way gear 154 includes a one-way bearing (not shown) built therein. The one-way gear 154 transmits a rotational force to the torque limiter 155 only when the tray unit 110 pivots from the second position to the first position.

The torque limiter 155 applies a pivotal load of a given magnitude to the tray unit 110. Here, the one-way gear 154 is provided between the tray unit 110 and the torque limiter 155. Accordingly, only when the tray unit 110 pivots from the second position to the first position, a pivotal load is transmitted from the torque limiter 155 to the tray unit 110. On the other hand, when the tray unit 110 pivots from the first position to the second position, a pivotal load is not transmitted from the torque limiter 155 to the tray unit 110.

Furthermore, when the degree of opening of the tray unit 110 is prescribed, a weight moment of the tray unit 110 becomes equal to a torque of the torque limiter 155. The degree of opening of the tray unit 110 refers to a pivotal angle of the tray unit 110 with respect to the first position.

Figure 16:
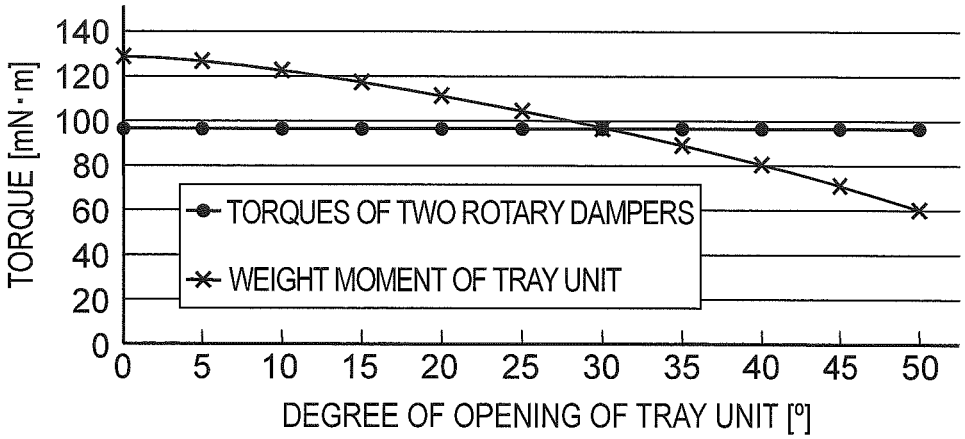
FIG. 16 is a view showing a relationship among torques of two rotary dampers around a pivotal shaft, a weight moment of the tray unit around the pivotal shaft, and the degree of opening of the tray unit of the paper sheet post-processor according to the embodiment of the present disclosure.

Specifically, as shown in FIG. 16, a weight moment of the tray unit 110 around the pivotal shaft 111 decreases with increasing degree of opening of the tray unit 110. On the other hand, torques of the two torque limiters 155 acting around the pivotal shaft 111 via the two-stage gears 152 and 153 is constant regardless of the degree of opening of the tray unit 110. Further, when the degree of opening of the tray unit 110 is 30 degrees, the weight moment of the tray unit 110 around the pivotal shaft 111 is equal to the torques of the torque limiters 155 acting around the pivotal shaft 111.

Accordingly, when the degree of opening of the tray unit 110 is 30 degrees or more, the tray unit 110 stops at the degree and is held at that position. On the other hand, when the degree of opening of the tray unit 110 is less than 30 degrees, the tray unit 110 pivots toward the first position. That is, in a case where the tray unit 110 is operated to pivot 30 degrees or more upward from the first position and is let go of, the tray unit 110 is held at that position.

On the other hand, in a case where the tray unit 110 is operated to pivot from the second position to a position at which the degree of opening of the tray unit 110 is less than 30 degrees and is let go of, the tray unit 110 pivots to the first position while being decelerated by the torque limiters 155. The second position is a position at which the degree of opening of the tray unit 110 is 30 degrees or more and 50 degrees or less.

In this embodiment, as described above, the tray unit 110 is disposed selectively at the first position at which the paper sheet S discharged through the lower discharge port 85 can be loaded on the lower discharge tray 121 or at the second position at which the paper sheet tray 63 inside the device main body 161 is exposed from the one side surface 161*a*. For example, at the occurrence of a jam (a paper jam) in a vicinity of the paper sheet tray 63, the tray unit 110, therefore, is disposed at the second position. Thus, the paper sheet tray 63 inside the device main body 161 can be exposed from the one side surface 161*a*, so that it is possible to improve a jam clearance property.

Furthermore, the discharge drive mechanism 132, which is a heavy object, is disposed at the center portion of the tray unit 110 in the paper sheet width direction, and thus a phenomenon can be suppressed in which the center of gravity of the tray unit 110 is biased to one side in the paper sheet width direction. This can suppress a phenomenon in which the tray unit 110 is bent (warped) when operated to pivot. Thus, it is possible to improve operability in operating the tray unit 110 to pivot.

Furthermore, as described above, on the back of the lower discharge tray 121 of the tray unit 110, the handle 110*a* is provided at the end portion of the lower discharge tray 121 on the downstream side in the paper sheet discharge direction and at the center portion thereof in the paper sheet width direction. The handle 11*a* is grasped for operating the tray unit 110 to pivot between the first position and the second position. This can further suppress the phenomenon in which the tray unit 110 is bent (warped) when operated to pivot. It is, therefore, possible to further improve the operability in operating the tray unit 110 to pivot.

Furthermore, as described above, there is provided the load mechanism 150 that applies a pivotal load to the tray unit 110. Thus, even in a case where the tray unit 110 is operated to pivot from the second position to the first position and is let go of while pivoting, a pivoting motion of the tray unit 110 under gravity can be decelerated by the load mechanism 150. This can suppress an impact on the tray unit 110 upon reaching the first position.

Furthermore, as described above, the load mechanism 150 includes the torque limiter 155 that applies a pivotal load of a given magnitude to the tray unit 110 when the tray unit 110 pivots from the second position to the first position and the load transmission member that connects the torque limiter 155 to the tray unit 110 (the pivotal gear 151, the two-stage gears 152 and 153, and the one-way gear 154). Thus, a pivotal load can be easily applied to the tray unit 110.

Furthermore, as described above, the load transmission member (the pivotal gear 151, the two-stage gears 152 and 153, and the one-way gear 154) includes the one-way gear 154 that transmits a pivotal load from the torque limiter 155 to the tray unit 110 only when the tray unit 110 pivots from the second position to the first position. Thus, when the tray unit 110 pivots from the first position to the second position, the load mechanism 150 does not function (a torque of the torque limiter 155 is not transmitted to the tray unit 110). This can suppress a deterioration in operability of the tray unit 110.

Furthermore, as described above, in a case where the degree of opening (the pivotal angle) of the tray unit 110 is equal to or more than a prescribed angle (here, 30 degrees), a weight moment of the tray unit 110 around the pivotal shaft 111 becomes equal to or less than a torque of the torque limiter 155 acting around the pivotal shaft 111, so that the tray unit 110 stops at the degree. Thus, even in a case where the tray unit 110 is operated to pivot at a prescribed angle or more from the first position and is let go of, the tray unit 110 is held at that position. There is, therefore, no need to support the tray unit 110 with hands at the time of a jam clearing process, and thus it is possible to further improve the jam clearance property.

Furthermore, in a case where the degree of opening of the tray unit 110 is less than a prescribed angle (here, 30 degrees), a weight moment of the tray unit 110 around the pivotal shaft 111 becomes larger than a torque of the torque limiter 155 acting around the pivotal shaft 111. This causes the tray unit 110 to pivot from the degree toward the first position. Thus, even in a case where, in closing the tray unit 110 (in operating the tray unit 110 to pivot from the second position toward the first position), the tray unit 110 is operated to pivot until the degree of opening of the tray unit 110 becomes less than the prescribed angle and is let go of, the tray unit 110 pivots by gravity to the first position. It is, therefore, possible to further improve the operability of the tray unit 110.

Furthermore, as described above, a downstream end of the paper sheet tray 63 is disposed at a position below the tray unit 110. With this configuration, at the time of occurrence of a jam in a vicinity of the downstream end of the paper sheet tray 63, the tray unit 110 is disposed at the second position, and thus the vicinity of the downstream end of the paper sheet tray 63 can be exposed. It is, therefore, possible to considerably improve the jam clearance property.

The embodiment disclosed herein is to be construed in all respects as illustrative and not limiting. The scope of the present disclosure is indicated by the appended claims rather than by the foregoing description of the embodiment, and all changes that come within the meaning and range of equivalency of the claims are intended to be embraced therein.

For example, while the foregoing embodiment has shown an example in which the paper sheet folding unit 60 includes the first folding device 70 and the second folding device 90, the present disclosure is not limited thereto. It is not required that the paper sheet folding unit 60 include the second folding device 90.

Furthermore, while the foregoing embodiment has shown an example in which the load mechanism 150 is provided with the torque limiter 155 that applies a pivotal load of a given magnitude to the tray unit 110, the present disclosure is not limited thereto. For example, the load mechanism 150 may be provided with a damper that generates a load according to a pivotal speed of the tray unit 110.

Furthermore, while the foregoing embodiment has shown an example in which the one-way gear 154 including the one-way bearing built therein is used as a one-way mechanism, the present disclosure is not limited thereto. As the one-way mechanism, a ratchet, a one-way clutch, or the like may also be used.

Furthermore, while the foregoing embodiment has shown an example in which the torque limiter 155 is used to hold the tray unit 110 at the second position, the present disclosure is not limited thereto. For example, a configuration may be adopted in which an engagement portion provided in the tray unit 110 engages with an engaged portion provided in the device main body 161 so that the tray unit 110 is held at the second position.

What is claimed is:

1. A sheet folding device, comprising:

a device main body;

a sheet tray that is built in the device main body and on which a sheet is carried in and the sheet is loaded;

a folding unit that performs a folding process with respect to the sheet loaded on the sheet tray;

a sheet discharge port that is provided on one side surface of the device main body and through which the sheet applied the folding process is discharged; and a tray unit that is provided on the one side surface of the device main body and includes a discharge tray on which the sheet discharged through the sheet discharge port is loaded, wherein the tray unit is supported to the device main body so as to be pivotable in an up-down direction about a pivotal shaft that is provided at an end portion of the tray unit on an upstream side in a sheet discharge direction and extends in a sheet width direction orthogonal to the sheet discharge direction, the tray unit includes:

a pair of conveyance members that is arranged, along the sheet discharge direction, respectively on both sides with respect to a center portion of the discharge tray in the sheet width direction and convey the sheet on the discharge tray to a downstream side in the sheet discharge direction;

a drive mechanism that is disposed, below the discharge tray, between the pair of conveyance members and at the center portion of the discharge tray in the sheet width direction and drives the pair of conveyance members; and a drive housing that houses the drive mechanism, the device main body has an opening provided through the one side surface, and the tray unit is disposed selectively at a first position at which the sheet discharged through the sheet discharge port can be loaded on the discharge tray and at a second position at which the sheet tray inside the device main body is exposed from the one side surface via the opening, being above the first position.

2. The sheet folding device according to claim 1, wherein the tray unit further includes a cover member that is disposed below the drive housing, and the cover member closes the opening when the sheet tray is disposed at the first position and opens the opening when the sheet tray is disposed at the second position.

3. The sheet folding device according to claim 1, wherein on a back of the discharge tray of the tray unit, a handle is provided at an end portion of the discharge tray on a downstream side in the sheet discharge direction and at a center portion thereof in the sheet width direction, the handle being adapted to be grasped for operating the tray unit to pivot.

4. The sheet folding device according to claim 1, further comprising:

a load mechanism that applies a pivotal load to the tray unit.

5. The sheet folding device according to claim 1, further comprising:

a bad mechanism that applies a pivotal load to the tray unit, wherein the load mechanism includes:

a torque limiter that applies a pivotal load of a given magnitude to the tray unit when the tray unit pivots from the second position to the first position; and a load transmission member that connects the torque limiter to the tray unit.

6. The sheet folding device according to claim 5, wherein the load transmission member includes:

a one-way mechanism that transmits a pivotal load from the torque limiter to the tray unit only when the tray unit pivots from the second position to the first position.

7. The sheet folding device according to claim 5, wherein in a case where a pivotal angle of the tray unit upwardly with respect to the first position is equal to or more than a prescribed angle, a weight moment of the tray unit around the pivotal shaft becomes equal to or less than a torque of the torque limiter acting around the pivotal shaft, so that the tray unit stops at the pivotal angle, and in a case where the pivotal angle of the tray unit upwardly with respect to the first position is less than the prescribed angle, the weight moment of the tray unit around the pivotal shaft becomes larger than the torque of the torque limiter acting around the pivotal shaft, so that the tray unit pivots from the pivotal angle toward the first position.

8. The sheet folding device according to claim 1, wherein a downstream end of the sheet tray is disposed at a position below the tray unit.

9. A sheet post-processor, comprising:

the sheet folding device according to claim 1, wherein the sheet post-processor performs predetermined post-processing with respect to the sheet.

10. An image forming system, comprising:

the sheet post-processor according to claim 9; and an image forming apparatus to which the sheet post-processor is connected and that forms an image on the sheet and coveys the sheet on which the image has been formed to the sheet post-processor.

11. A sheet folding device, comprising:

a device main body;

a sheet tray that is built in the device main body and on which a sheet is carried in and the sheet is loaded;

a folding unit that performs a folding process with respect to the sheet loaded on the sheet tray;

a sheet discharge port that is provided on one side surface of the device main body and through which the sheet applied the folding process is discharged; and a tray unit that is provided on the one side surface of the device main body and includes a discharge tray on which the sheet discharged through the sheet discharge port is loaded, wherein the tray unit is supported to the device main body so as to be pivotable in an up-down direction about a pivotal shaft that is provided at an end portion of the tray unit on an upstream side in a sheet discharge direction and extends in a sheet width direction orthogonal to the sheet discharge direction, the tray unit includes:

a pair of conveyance members that is arranged, along the sheet discharge direction, respectively on both sides with respect to a center portion of the discharge tray in the sheet width direction and convey the sheet on the discharge tray to a downstream side in the sheet discharge direction;

a drive mechanism that is disposed, below the discharge tray, between the pair of conveyance members and at the center portion of the discharge tray in the sheet width direction and drives the pair of conveyance members; and a drive housing that houses the drive mechanism, and a downstream end of the sheet tray is disposed at a position below the tray unit.

12. A sheet post-processor, comprising:

the sheet folding device according to claim 11, wherein the sheet post-processor performs predetermined post-processing with respect to the sheet.

13. An image forming system, comprising:

the sheet post-processor according to claim 12; and an image forming apparatus to which the sheet post-processor is connected and that forms an image on the sheet and coveys the sheet on which the image has been formed to the sheet post-processor.

* * * * *